US007086474B1

(12) United States Patent
Trevithick et al.

(10) Patent No.: US 7,086,474 B1
(45) Date of Patent: Aug. 8, 2006

(54) APPARATUS AND METHOD FOR HANDLING A BLOWOUT PREVENTER

(75) Inventors: Mark W. Trevithick, Houston, TX (US); Miles A. Hobdy, Houston, TX (US)

(73) Assignee: T & T Engineering Services, Inc., Houston, TX (US)

( * ) Notice: Subject to any disclaimer, the term of this patent is extended or adjusted under 35 U.S.C. 154(b) by 32 days.

(21) Appl. No.: 10/437,365

(22) Filed: May 13, 2003

(51) Int. Cl.
*E21B 19/00* (2006.01)
*E21B 33/06* (2006.01)

(52) U.S. Cl. ..... 166/379; 166/85.4

(58) Field of Classification Search ..... 166/379, 166/85.1, 85.4, 85.3; 175/52, 85; 251/1.1
See application file for complete search history.

(56) References Cited

U.S. PATENT DOCUMENTS 3,498,375 A 3/1970 McEwen et al.
4,007,782 A 2/1977 Nybo et al.
4,359,089 A 11/1982 Strate et al.
5,121,793 A 6/1992 Busch et al.
5,816,565 A 10/1998 McGuffin
5,957,431 A 9/1999 Serda, Jr.
6,053,255 A 4/2000 Crain
6,079,490 A * 6/2000 Newman ..... 166/77.51
6,276,450 B1 8/2001 Seneviratne
2004/0231857 A1* 11/2004 Kainer et al. ..... 166/379

* cited by examiner

*Primary Examiner*—Jennifer H. Gay
*Assistant Examiner*—G M Collins
(74) *Attorney, Agent, or Firm*—Egbert Law Offices

(57) ABSTRACT

A blowout preventer handling apparatus including a frame structure, a carriage slidably supported on the frame structure, a raising frame pivotally supported on the carriage, and a positioner mechanism cooperatively connected to the raising frame for receiving the blowout preventer therein and for moving the blowout preventer upwardly-and-downwardly, rotationally, and side-to-side. A tray is slidably supported on the carriage so as to be movable between a first position away from the positioning mechanism to a position directly below the positioning mechanism. An outrigger assembly is selectively movable outwardly of an end of the frame structure.

28 Claims, 16 Drawing Sheets

APPARATUS AND METHOD FOR HANDLING A BLOWOUT PREVENTER

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to blowout preventers. More particularly, the present invention relates to drilling rig systems. More particularly, the present invention relates to blowout preventer handling systems whereby a blowout preventer can be positioned in a desired location with respect to the wellhead.

BACKGROUND OF THE INVENTION

As part of the process of drilling wells in the earth, joints of pipe called "casing" are joined and placed in a hole drilled to a first intermediate depth to form a casing "string". Cement is pumped between the casing string and the wall of the hole to mechanically hold the casing in place and prevent flow outside the casing. The well has been drilled deeper through the string of casing. Before drilling begins through the casing, blowout preventers are attached to the top of the casing. The purpose of the blowout preventer is to seal the top of the casing should excess pressure be encountered when drilling the well deeper.

Blowout preventers are often referred to in the oil and gas industry as "BOPs". The blowout preventers are used to prevent blowouts during the drilling and production of oil and gas wells. The blowout preventer is installed at the well head for the purpose of preventing the escape of pressure in an annular space between the casing and drill pipe, or in an open hole during drilling and completion operations. During the drilling operation from a drilling platform, the blowout preventer is located some distance below the drilling rig floor. The drilling platform may include a rotary table or a top drive which is mounted within a circular opening in the floor. The rotary table is used to turn the drill string and support the drilling sting assembly. The blowout preventer is mounted on top of the well casing through which the drill string passes. These blowout preventers are massive structures, often weighing an excess of 35 tons in some drilling operations. The blowout preventers extend from the top of the casing to within a short distance of the bottom of the drilling platform.

It is common practice in the industry today for the large individual components of the BOP stack to be transported individually to the drilling site and erected under the drilling structure. This assembly operation usually requires laborers to work in very close contact with these large components within a limited space under the drilling structure. Additionally, with the limited working height and space under the drilling structure, the laborer normally has few lifting devices that can fit into this space to assist in this operation. The "stacking" of these large components normally requires one or more of the laborers to work under these large pieces while they are suspended overhead. Once the BOP stack is in place, the equipment must be pressure tested to check its ability to perform during the drilling operations. If any one of the components fails to test properly, the assembly process may have to be repeated to repair or replace the faulty component. This enhances the risks to personnel and the time required to bring the drilling rig to an operational state. Injuries ranging from the incidental to the serious have been experienced industry-wide due to this operation.

Additionally, during the well drilling, the BOP stack may be raised and lowered to gain the access required to install or remove well components that are located under the BOP stack. Again, this requires personnel to work in a limited space under a large suspended load with the minimal amount of lifting devices available to work properly in this limited space. These operations are especially dangerous since the removal and placement of well components under the BOP stack normally takes place at or below ground level leaving little or no escape from falling components.

During all the "stacking" and component installation process, alignment of components is a critical factor. Virtually all these components are assembled with the use of flanges. This requires that proper alignment must exist between the mating pieces to be able to install gaskets, seals and the bolting required for holding the components together. This requirement is not trivial since the lack of ability to maneuver heavy flanges, one relative to the other, greatly increases the difficulty of installation in a safe and proper manner.

Another concern affecting the BOP "stacking" operation is the lack of preventive maintenance performed on the lifting equipment. The lack of preventive maintenance can lead to the risk of failure of these devices. Since most of these lifting devices reside high off the ground and out of reach, regular maintenance is difficult to perform. This scenario is especially dangerous for the most common lifting devices where wire ropes or chains are the primary lifting means. Left unattended, these components can become prone to failure due to exposure to the inherently corrosive environment in and around the well area.

Since the BOP stack is one of the single most important pieces of safety equipment involved in the drilling operations, its functionality is essential and the time required to ensure this functionality is unavoidable. Given the current industry practice of BOP stack assembly, this time can become a critical path task in trying to prepare a drilling rig for operation. Any additional time required to bring a drilling rig up to its operational state obviously has negative economic consequences.

In the past, various U.S. patents have issued with respect to blowout preventer handling devices. U.S. Pat. No. 3,498,375, issued on Mar. 3, 1970 to J. D. McEwen, teaches an oil well derrick substructure with a blowout preventer dolly. The blowout preventer dolly is mounted on the one side of the structural steel framework of the oil well derrick. The dolly can be moved to a central area after the rotary table support has been removed from the central area of the structural steel framework. The dolly will support a blowout preventer in a manner so as to move the blowout preventer across an upper part of the job structure into the space vacated by the rotary table support. The blowout preventer can be lifted from the dolly by the travelling block. The dolly can then be retracted back to its outer position and the blowout preventer lowered into position.

U.S. Pat. No. 4,007,782, issued on Feb. 15, 1977 to Nyboe et al., describes a parking device for containing a blowout preventer aboard a floating drilling station. The parking device includes a parking frame which is capable of holding the blowout preventer with its center of gravity lining above the point to which the blowout preventer is supported on the parking frame. The blowout preventer can be moved as a unit back and forth between a parked position and an installed position for utilization on the drilling station. A first drive mechanism is provided for raising and lowering the parking frame. A second drive mechanism is provided for moving the parking frame sideways.

U.S. Pat. No. 4,359,089, issued on Nov. 16, 1982 to Strate et al., teaches a carrier for an oil well blowout preventer. This carrier includes a skid defined by a pair of sides with cross bars extending therebetween. A carriage is slidably mounted on rollers on the skid for movement toward and away from the wellhead. A cradle is pivotally mounted on the carriage for carrying a blowout preventer in a horizontal position and for movement from such horizontal position to a vertical position. Hydraulic cylinders are provided for moving the carriage along the skid, for moving a carriage transversely to align the blowout preventer with the wellhead, for moving the cradle from a horizontal to an erect position, and for moving the blowout preventer and a slide portion of the cradle vertically into and out of engagement with a well casing.

U.S. Pat. No. 5,121,1993, issued on Jun. 16, 1992 to Bush et al., describes capping equipment for blowout wells. This capping equipment includes a blocking system for blocking of the well, an anchorage system to support the blocking system, and a movable and inclinable support and positioning system. The positioning system includes a sliding ramp and mechanism for moving the blocking system to bring it above and into the casing to be blocked off.

U.S. Pat. No. 5,816,565, issued on Oct. 6, 1998 to M. H. McGufin, teaches a hydraulic blowout preventer lifter. This lifting apparatus includes a frame assembly having a pair of side beams spaced parallel to one another. A sliding sheave assembly is mounted on the frame assembly. The sliding sheave assembly has a first shaft with a plurality of sheaves mounted thereto and a second shaft with a plurality of second sheaves mounted thereto. A cylinder has a first end connected to the frame assembly and a rod end attached to the sliding sheave assembly. The cylinder rod end is capable of moving longitudinally relative to the first end to thereby alter the distance between the shafts. A cable having first and second ends is attached to the frame assembly and is received by the sheaves. A portion of the cradle is received by a snatch block having a lifting hook for attaching to the blowout preventer. The blowout preventer is lifted by extending the rod end of the cylinder to increase the distance between the first and second shafts. U.S. Pat. No. 5,957,431, issued on Sep. 28, 1999 to E. Serda, Jr., teaches a similar blowout preventer lifting device.

U.S. Pat. No. 6,053,255, issued on Apr. 25, 2000 to J. A. Crain, describes an apparatus and method for lifting blowout preventers. A series of tables are connected to the drums of winches and can also be secured to the blowout preventer so as to provide a compact and safe technique for the lifting of the blowout preventer.

U.S. Pat. No. 6,276,450, issued on Aug. 21, 2001 to P. D. Seneviratne, describes an apparatus and method for the rapid replacement of upper blowout preventers. The system utilizes a hydraulic pressure booster to operate a pipe handling/torque wrench. An air amplifier is provided to increase the air pressure to a main shaft break of the top drive system in order to provide torque back-up. A rotary table back-up structure provides a torque back-off for removing the upper blowout preventer. A drive ring prevents relative rotation between the rotary table structure and the blowout preventer.

These prior art blowout preventers do provide techniques for manipulating the blowout preventer so as to bring the lower flange of the blowout preventer into proximity with the upper flange of the wellhead. Unfortunately these devices do not ultimately provide for "fine" adjustment of the blowout preventer with respect to this upper flange. For example, even when the lower flange is in proximity to the top flange of the wellhead, the planes of the facing surfaces can be so offset as to prevent the bolts from passing through the associated bolt holes. In other circumstances, the flange of the blowout preventer is rotationally offset from the flange of the wellhead so that the bolt holes are not axially aligned. In other circumstances, the flange of the blowout preventer will be offset, by a small distance, to the side of the flange of the wellhead. As a result, it is necessary for workers to position themselves in the cellar so as to further manupilate the blowout preventer and to provide this precise alignment. Additionally, none of these prior art devices can allow for the precise installation and manipulation of a spacer spool between the bottom flange of the blowout preventer and the upper flange of the wellhead.

It is an object of the present invention to provide a blowout preventer handling apparatus which enhances the ability to deliver an assembled and tested blowout preventer stack to a drilling site.

It is another object of the present invention to provide a blowout preventer handling apparatus and method which can be utilized with various types of drilling structures.

It is another object of the present invention to provide a blowout preventer handling apparatus and method that can lift a variety of types of stacked configurations of blowout preventers without modifications to the stacked components.

It is a further object of the present invention to provide a method and apparatus for blowout preventer handling which is safe and avoids the need for personnel to be directly under the blowout preventer stack.

It is still another object of the present invention to provide a method and apparatus for a blowout preventer handling which can precisely align the associated flanges of the wellhead and the blowout preventer without the need for manual manipulation.

It is a further object of the present invention to provide a blowout preventer handling method and apparatus which allows the blowout preventers stack pressure and function testing to occur on site.

It is an further object to provide a method and apparatus which allows for the loose alignment of the transport skid or handling mechanisms within the wellhead area while still achieving precise alignment of the connectors.

It is a further object of the present invention to provide a positive means of lifting the blowout preventer stack and wellhead components.

It is another object of the present invention to provide a blowout preventer method and apparatus which can deliver and remove wellhead components below the raised blowout preventer stack without the need for personnel to be positioned directly under the stack.

These and other objects and advantages of the present invention will become apparent from a reading of the attached specification and appended claims.

BRIEF SUMMARY OF THE INVENTION

The present invention is a blowout preventer handling apparatus which comprises a frame structure, a carriage slidably supported on the frame structure, a raising frame pivotally supported on the carriage and pivotable between a first position in generally parallel relation to the carriage and a second position generally transverse to the carriage, and a positioning means cooperatively connected to the raising frame or to the carriage. This positioning means is for receiving the blowout preventer therein and for moving the blowout preventer upwardly-and-downwardly, rotationally and side-to-side.

In the present invention, the frame structure has an outrigger assembly extendable outwardly from one end thereof. This outrigger assembly comprises a first beam extendable outwardly from one side of the frame structure, a second beam extendable outwardly from an opposite side of the frame structure, a first foot extendable downwardly from an end of the first beam opposite the frame structure, and a second foot extendable downwardly from an end of the second beam opposite the frame structure.

In the present invention, the carriage includes a carriage frame which is mounted by a roller assembly on a surface of the frame structure, and a piston-and-cylinder assembly having one end connected to the carriage frame and an opposite end connected to the frame structure. This piston-and-cylinder assembly is for selectively moving the carriage frame along the surface of the frame structure. A tray is slidably supported on the carriage between the sides of the frame structure. This tray is movable between a first position away from the positioning means to a position directly below the positioning means. The tray can have a turntable which is rotatably mounted thereto.

In the present invention, the raising frame includes at least one post. The post is pivotally connected to the carriage. A raising cylinder has one end connected to the carriage and an opposite end connected to the post. This raising cylinder is for moving the post from the first position adjacent to the carriage to the second position generally transverse to the carriage. The positioning means is slidably connected to the raising frame for moving the blowout preventer in the upward and downward orientation.

In the present invention, the positioning means comprises a wrench frame slidably positioned on the raising frame and having a blowout preventer receptacle thereon, a rotary cylinder connected to the wrench frame for rotating the blowout preventer receptacle, and a transverse cylinder connected to the wrench frame for moving the blowout preventer receptacle side-to-side with respect to the wrench frame. A lift cylinder has one end connected to the raising frame and an opposite end connected to the wrench frame. This lifting cylinder serves to move the wrench frame upwardly and downwardly.

In the present invention, the wrench frame comprises a housing, a lift plate having the blowout preventer receptacle formed therein and extending outwardly of the housing, a rotary plate mounted on the lift plate and having a surface thereon for receiving the blowout preventer, and a guide member affixed to the housing and extending thereacross. The rotary cylinder includes a piston-and-cylinder assembly having one end connected to the rotary plate and an opposite end connected to the lift plate. This piston-and-cylinder assembly is actuatable so as to rotate the rotary plate relative to the lift plate. The transverse cylinder means includes a piston-and-cylinder assembly having one end connected to the lift plate and an opposite end connected to the lift plate. The lift plate is slidably supported on the guide member. The piston-and-cylinder assembly is selectively actuatable so as to move the lift plate along the guide member. A latch mechanism affixed to said lift plate adjacent to the receptacle. The latch mechanism is moveable to a position suitable for releasably retaining the blowout preventer in the receptacle.

The present invention is also a method of handling a blowout preventer comprising the steps of: (1) moving a frame structure into proximity to a wellhead; (2) raising the blowout preventer upwardly by pivoting the raising frame with respect to the carriage; (3) extending the carriage outwardly such that a bottom flange of the blowout preventer is in proximity to a top flange of the wellhead; and (4) manipulating the wrench assembly such that the bottom flange is aligned with the top flange.

Importantly, in the present invention, the step of manipulating involves six degrees of movement for the purpose of properly aligning the bottom face of the connector of the blowout preventer with the top face of the connector of the wellhead. In particular, the step of manipulating includes, first, rotating the blowout preventer by pivoting the wrench assembly so as to axially align bolt holes of the connector of the blowout preventer with bolt holes of the connector of the wellhead. The step of manipulating includes, secondly, moving the wrench assembly side-to-side such that a center of connector of the blowout preventer is aligned with a center of the connector of the wellhead. The step of manipulating includes, thirdly, the sliding of the carriage toward or away from the wellhead such that a center of the connector of the blowout preventer is aligned with a center of the connector of the wellhead. The step of manipulating includes, fourthly, the pivoting of the raising frame angularly with respect to the carriage such that the bottom surface of the connector of the wellhead is in parallel planar relationship to a top surface of the connector of the wellhead. Fifthly, the step of manipulating can include moving the wrench assembly upwardly or downwardly on the raising frame such that the connector of the blowout preventer is juxtaposed against the connector of the wellhead. Finally, the step of manipulating can include independently varying a height of the outriggers so as to adjust a side-to-side angularly alignment form the bottom connector with the top connector. Each of the connectors is a flange.

The method of the present invention also includes the step of extending the outrigger assembly outwardly of the frame structure such that feet of the outrigger assembly are positioned on a side of the wellhead opposite the frame structure.

The method of the present invention also enhances the ability to transport such a blowout preventer to the wellhead site. The steps of this method include: (1) transporting the frame structure on a bed of a vehicle toward the wellhead; (2) off-loading an end of the frame structure in proximity to the wellhead such that the frame structure extends angularly off an end of the bed; (3) moving the vehicle away from the end of the frame structure; and (4) releasing the frame structure from the bed of the vehicle. The method can also include alternatively lifting the frame structure by a crane from the bed of the vehicle.

The present invention also allows for the installation of equipment between the bottom flange of the blowout preventer and the top flange of the wellhead. In particular, in the method of the present invention, the carriage will have a tray which is slidably supported thereon. The broad statement of the method includes the steps of: (1) positioning a piece of equipment on the tray; (2) sliding the tray and the piece of equipment outwardly of the end of the carriage so as to be in proximity to the wellhead; and (3) removing the piece of equipment from the tray. In the present invention, the attachment of the piece of equipment to the bottom flange of the blowout preventer can be achieved in a convenient and easy manner without requiring personnel within the cellar. In this method, the piece of equipment is a spacer spool having a top flange and a bottom flange. The method includes the steps of: (1) moving the tray such that the top flange of the spacer spool is aligned with the bottom flange of the blowout preventer; (2) bolting the top flange of the spacer spool to the bottom flange of the blowout preventer; (3) sliding the tray away from the bottom flange of the spacer spool, and (4) lowering the blowout preventer and the spacer spool toward the top flange of the wellhead such that the bottom flange of the spacer spool is juxtaposed against the top flange of the wellhead. The blowout preventer can be manipulated by the wrench assembly such that bolt holes of the spacer spool are axially aligned with the bolt holes of the top flange of the wellhead. The method of the present invention also can include the securing of bolts through respective pairs of bolt holes in the bottom flange of the blowout preventer and the top flange of the wellhead, releasing the wrench assembly from the blowout preventer, retracting the carriage along the frame structure, and pivoting the raising frame downwardly so as to be positioned in generally parallel relationship to the frame structure. The vehicle can then be brought in proximity to the frame structure such that the frame structure can be lifted upon the bed of the vehicle and transported to a desired location.

DETAILED DESCRIPTION OF THE INVENTION

Figure 1:
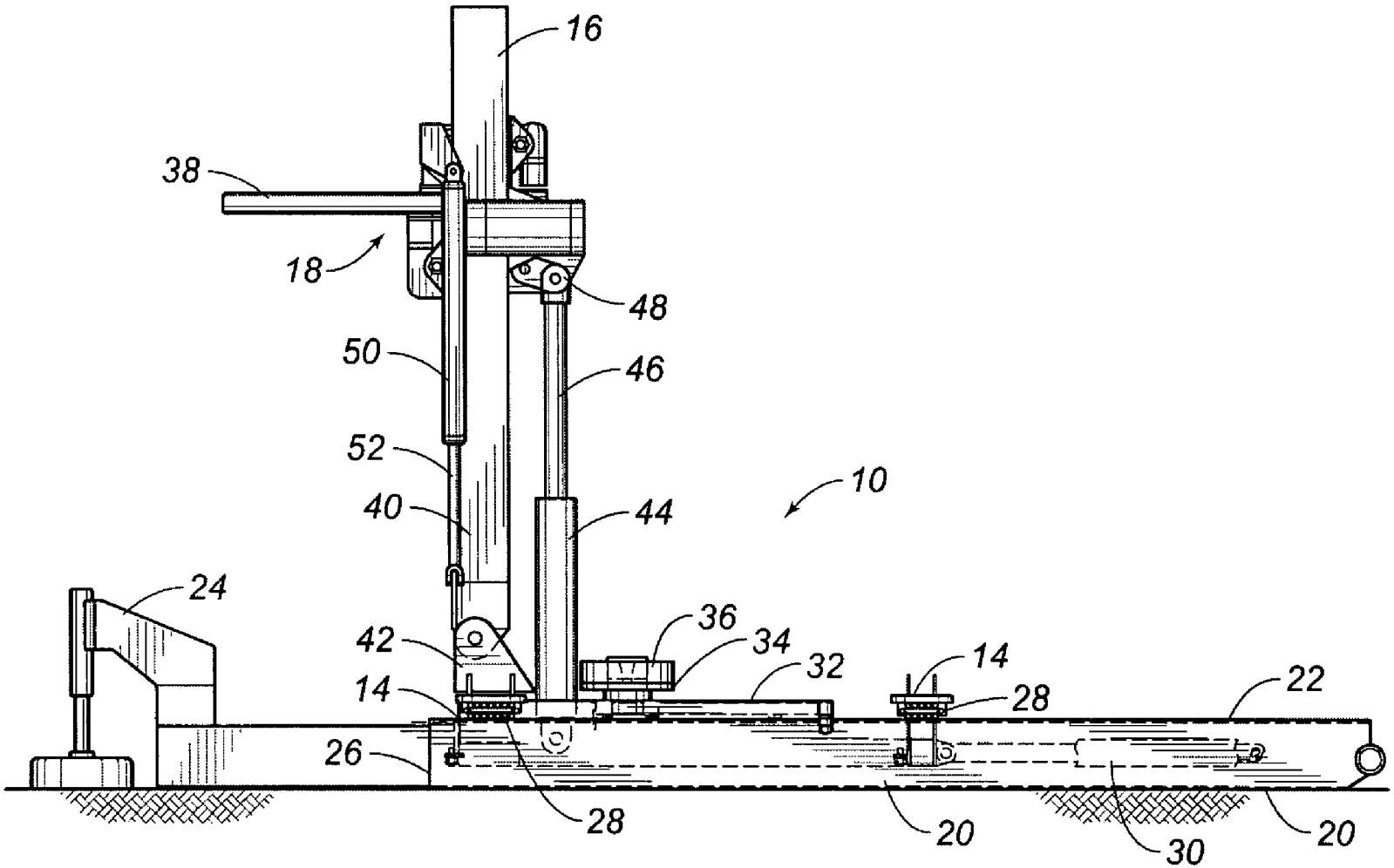
FIG. 1 is a side elevational view of the blowout preventer handling system of the present invention.

Referring to FIG. 1, there is shown the blowout preventer handling apparatus 10 in accordance with the preferred embodiment of the present invention. The blowout preventer handling apparatus 10 includes a frame structure 12, a carriage 14 slidably supported on the frame structure 12, a raising frame 16 pivotally supported on the carriage 14 so as to be pivotable between a first position in generally parallel relationship to the carriage 14 or the frame structure 12 and a second position, as shown in FIG. 1, generally transverse to the carriage 14. A positioning mechanism 18 is cooperatively connected to the raising frame 16. The positioning mechanism 18 serves to receive a blowout preventer therein and to move the blowout preventer upwardly-and-downwardly, rotationally, and side-to-side.

In FIG. 1, it can be seen that the frame structure 12 is a generally longitudinal assembly having a bottom surface 20 and a flat top surface 22. The carriage 14 travels along the top surface 22 of the frame structure 12. An outrigger assembly 24 is extendable outwardly from the end 26 of the frame structure 12.

The carriage 14 is mounted on roller assemblies 28 onto the top surface 22 of the frame structure 12. A hydraulic cylinder 30 has one end connected to the carriage 14 and an opposite end connected to the frame structure 12. The hydraulic cylinder 30 serves to selectively move the carriage 14 along the top surface 22 of the frame structure 12. A tray 32 is slidably mounted on the carriage 14. The tray 32 is movable between a first position away from the positioning mechanism 18 (as shown in FIG. 1) to a position directly below the positioning mechanism 18. A turntable 34 is rotatably mounted to the top surface of the tray 32 for receiving items of equipment thereon. In FIG. 1, it can be seen that a test flange 36 is mounted on the turntable 34. The tray 32 is configured so that it can slide along the carriage 14 for delivery to a position directly below the positioning mechanism 18 so that a piece of equipment can be attached to the bottom flange of the blowout preventer.

Figure 3:
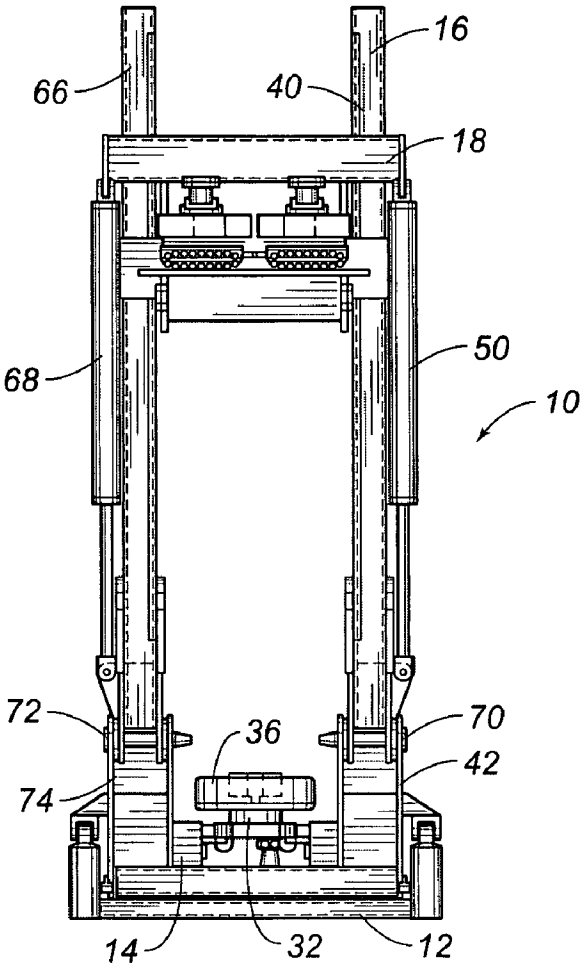
FIG. 3 is a frontal view of the blowout preventer handling system of the present invention.

In FIG. 1, it can be seen that the raising frame 16 is positioned in its vertical orientation. The lifting plate 38 of the positioning mechanism 18 extends outwardly transversely from the raising frame 16. The raising frame 16 will include a pair of posts 40 that will extend in generally parallel relationship to each other (as shown in FIG. 3). Each of the posts 40 is pivotally connected to a gusset structure 42 supported on the carriage 14. A raising cylinder 44 has its rod 46 pivotally mounted to the carriage 14. When the raising cylinder 44 is actuated, the rod 46 will extend outwardly from the raising cylinder 44 so as to move the raising frame 16 from its generally parallel position adjacent to the top surface 22 of the frame structure 12 to the vertical position, as shown in FIG. 1. The raising frame 16 also has the rod 52 of lift cylinder 50 affixed thereto. The opposite end of the lift cylinder 50 is connected to the lift plate 38 of the positioning mechanism 18. The lift cylinder 50 serves to move the lift plate 38 of the positioning mechanism 18 upwardly and downwardly along the length of the raising frame 16.

Figure 2:
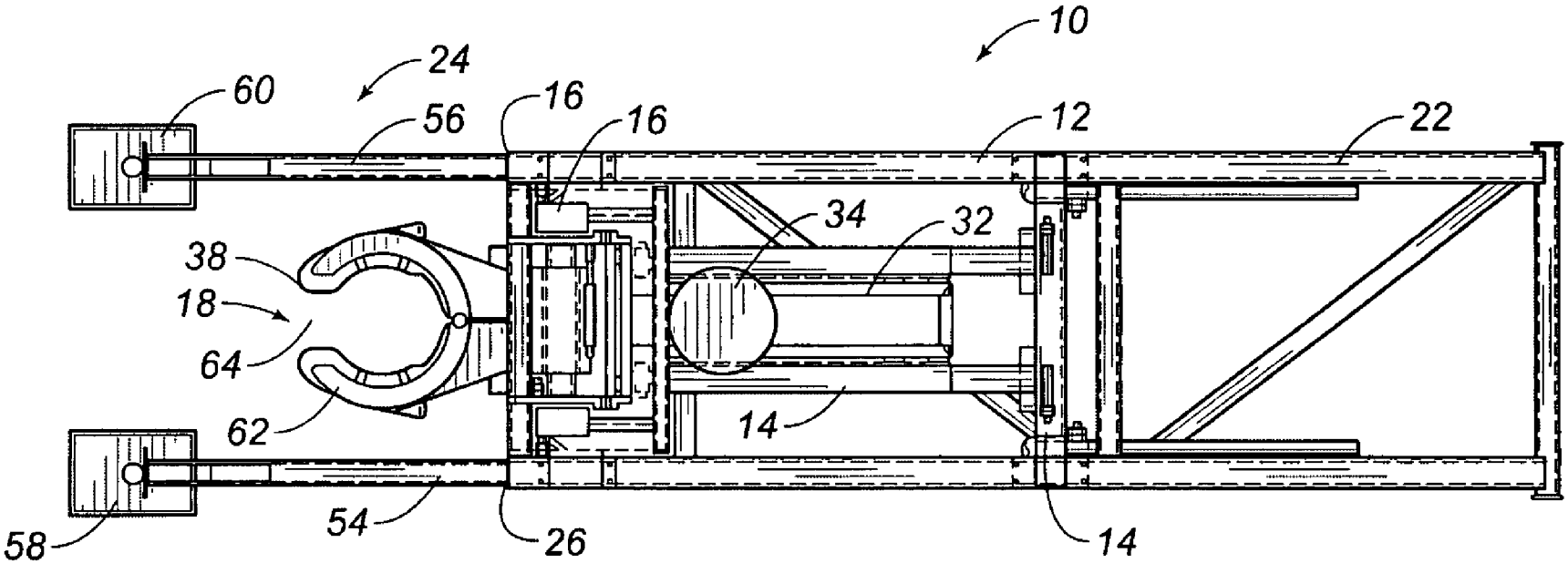
FIG. 2 is a plan view of the blowout preventer handling system of the present invention.

FIG. 2 shows a plan view of the apparatus 10 of the present invention. In FIG. 2, it can be seen that the frame structure 12 has a generally rectangular configuration. The carriage 14 is slidably mounted on the top surface 22 of the frame structure 12. The tray 32 is positioned within the carriage 14 so as to support the turntable 34 thereon. The raising frame 16 is positioned inwardly of the sides of the frame structure 12. The positioning mechanism 18 is illustrated as supported at the upper end of the raising frame 16.

In FIG. 2, it can be seen that the outrigger assembly 24 has been extended outwardly from the end 26 of the frame structure 12. The outrigger assembly 24 includes a first beam 54 and a second beam 56. A first foot 58 is positioned at an end of the first beam 54 opposite the frame structure 12. A second foot 60 is positioned at an end of the second beam 56, opposite the frame structure 12. The outrigger assembly 24 is joined so as to be extended outwardly and to provide support for the lifting and positioning of a blowout preventer as received within the positioning mechanism 18.

In FIG. 2, it can be seen that the positioning mechanism 18 includes lift plate 38 and a rotary plate 62 supported thereon. The rotary plate 62 is designed so as to impart rotational movement to a blowout preventer received within the receptacle 64 of the lift plate 38. The lift plate 38 will allow the blowout preventer (received within the blowout preventer receptacle 64) to be moved in side-to-side manner between the beams 54 and 56 of the outrigger assembly 24.

FIG. 3 shows a frontal end view of the blowout preventer handling apparatus of the present invention. In particular, in FIG. 3, the frame structure 12 serves to support the apparatus 10 on the earth. The raising frame 16 includes a pair of posts 40 and 66. Posts 40 and 66 extend in generally parallel relationship to each other. A cross member can extend between the posts 40 and 66 so as to provide structural stability thereto. Alternatively, the positioning mechanism 18 can be secured to the posts 40 and 66 so as to provide the structural stability thereto. Lift cylinders 50 and 68 extend so as to connect to the positioning mechanism 18 at one end and to the bottom of the posts 40 and 66, respectively, at the opposite end. The actuation of the lift cylinders 50 and 68 will cause the positioning mechanism 18 to move upwardly-and-downwardly along the length of the raising frame 16.

The carriage 14 is illustrated as secured to the posts 40 and 66 so as to move the raising frame 16 inwardly and outwardly relative to the length of the frame structure 12. The tray 32 is illustrated as positioned centrally between the posts 40 and 66 and interior of the carriage 14. Tray 32 allows the test flange 36 to be passed outwardly between the posts 40 and 66 for positioning directly above the wellhead and below the positioning mechanism. Each of the posts 40 and 66 is respectively pivotally supported at 70 and 72 to the gussets 42 and 74 of the carriage 14.

Figure 4:
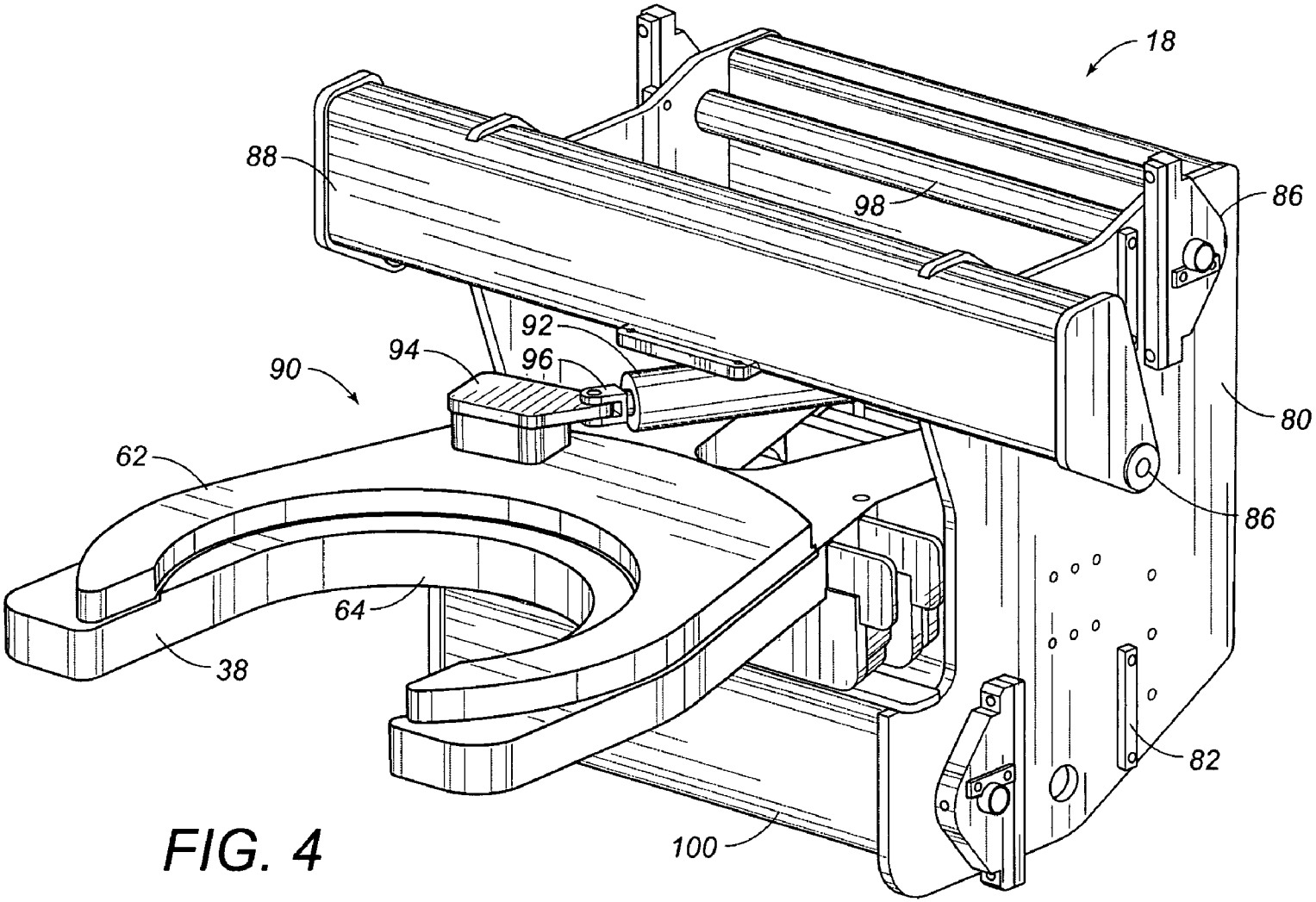
FIG. 4 is a perspective view showing the wrench assembly of the present invention.

FIG. 4 is a perspective view of the positioning mechanism 18 in accordance with the preferred embodiment of the present invention. The positioning mechanism 18 includes a housing 80 which can be slidably received on the raising frame 16 by the use of the wear pad 82 and the reaction blocks 84 and 86. The posts 40 of the raising frame 16 can pass between the wear pad 82 and the reaction block 84 so as to allow the housing 18 to properly slide along the length of the raising frame 16. The end of the lift cylinder 50 is pivotally connected at 86 at one end of structural plate 88. The configuration of the wear pad 82 and the reaction block 84 allow a certain flexible movement of the housing 80 as it travels upwardly-and-downwardly around the raising frame 16. A wrench assembly 90 extends outwardly of the housing 80 so as to provide for the grasping of a blowout preventer therein. The wrench assembly 90 includes the lift plate 38 and the rotary plate 62. The lift plate 38 includes the blowout preventer receptacle 64 therein. Conventionally, the receptacle 64 will be placed around the blowout preventer below the annular of the blowout preventer. The housing of the blowout preventer will then reside upon the top surface of the rotary plate 62. A piston-and-cylinder assembly 92 is pivotally connected to a bracket 94 of the rotary plate 62. The actuation of the piston-and-cylinder assembly 92 will cause the rod element 96 to move outwardly therefrom so as to properly rotate the rotary plate 62 upon the top surface of the lift plate 38. A pivot shaft 98 is affixed to opposite walls of the housing 80 and extends thereacross. A front load member 100 is also affixed so as to extend between the sides of the housing 80 and to provide for structural support and bearing surfaces for the operation of the side-to-side movement of the wrench assembly 90.

Figure 5:
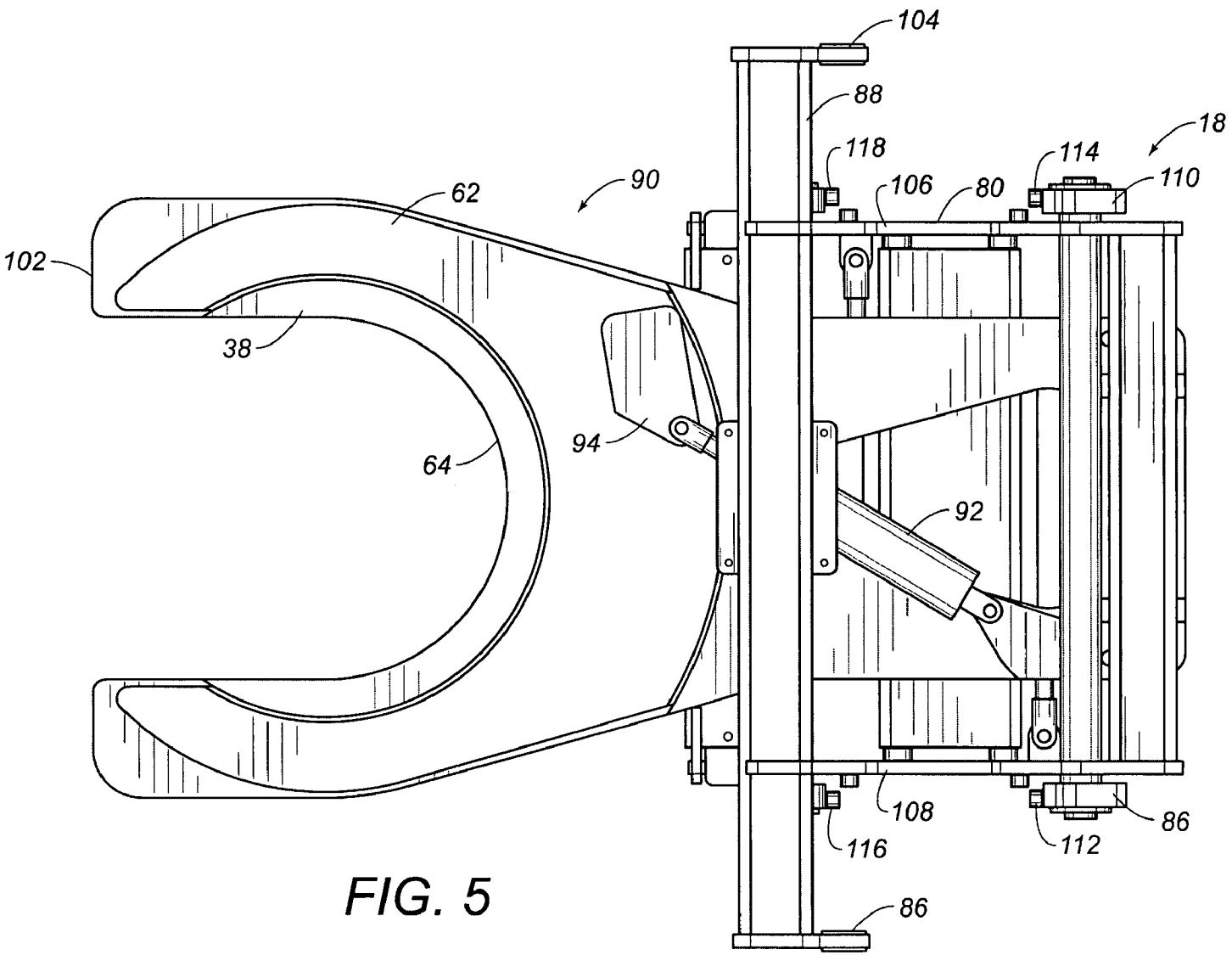
FIG. 5 is a plan view of the wrench assembly of the present invention with the housing removed therefrom.

FIG. 5 is a plan view showing the construction of the positioning mechanism 18 and its associated wrench assembly 90. The rotary plate 62 is illustrated as supported upon the lift plate 38. Lift plate 38 defines blowout preventer receptacle 64. In normal use, an appropriate latch mechanism can be applied adjacent to the end 102 of the lift plate 34 so as to assure that the blowout preventer is secured within the receptacle area 64. The rotary plate 62 is supported in an annular channel formed on the top surface of the lift plate 38. As such, when a rotational force is applied by the piston-and-cylinder assembly 92 onto the bracket 94 of the rotary plate 62, the rotary plate 62 will travel in a circular orientation with respect to the lift plate 38. Since the weight of the blowout preventer is being supported directly upon the top surface of the rotary plate 62, the blowout preventer can accordingly rotate with the rotation of the rotary plate 62.

In FIG. 5, structural member 88 is particularly illustrated as having pivotal connection 86 at one end and pivotal connection 104 at an opposite end. These pivotal connections are suitable for joining to the end of the lift cylinder 50 for the purposes of lifting the positioning mechanism 18 and, in particular, the wrench assembly 90 along the length of the raising frame.

The housing 80 in FIG. 5 is illustrated as having wall 106 and wall 108. The structural member 88 is fixedly secured to each of the walls 106 and 108. The pivot shaft 98 will extend through the walls 106 and 108 so as to support reaction blocks 86 and 110 at opposite ends thereof. The surface 112 of reaction block 86 and the surface 114 of reaction block 110 will contact the outer surfaces of the respective posts 40 and 66 of the raising frame 16. Wear pads 116 and 118 will bear against the opposite sides of the respective posts 40 and 66 such that the positioning mechanism 18 can be suitably received upon the raising frame.

Figure 6:
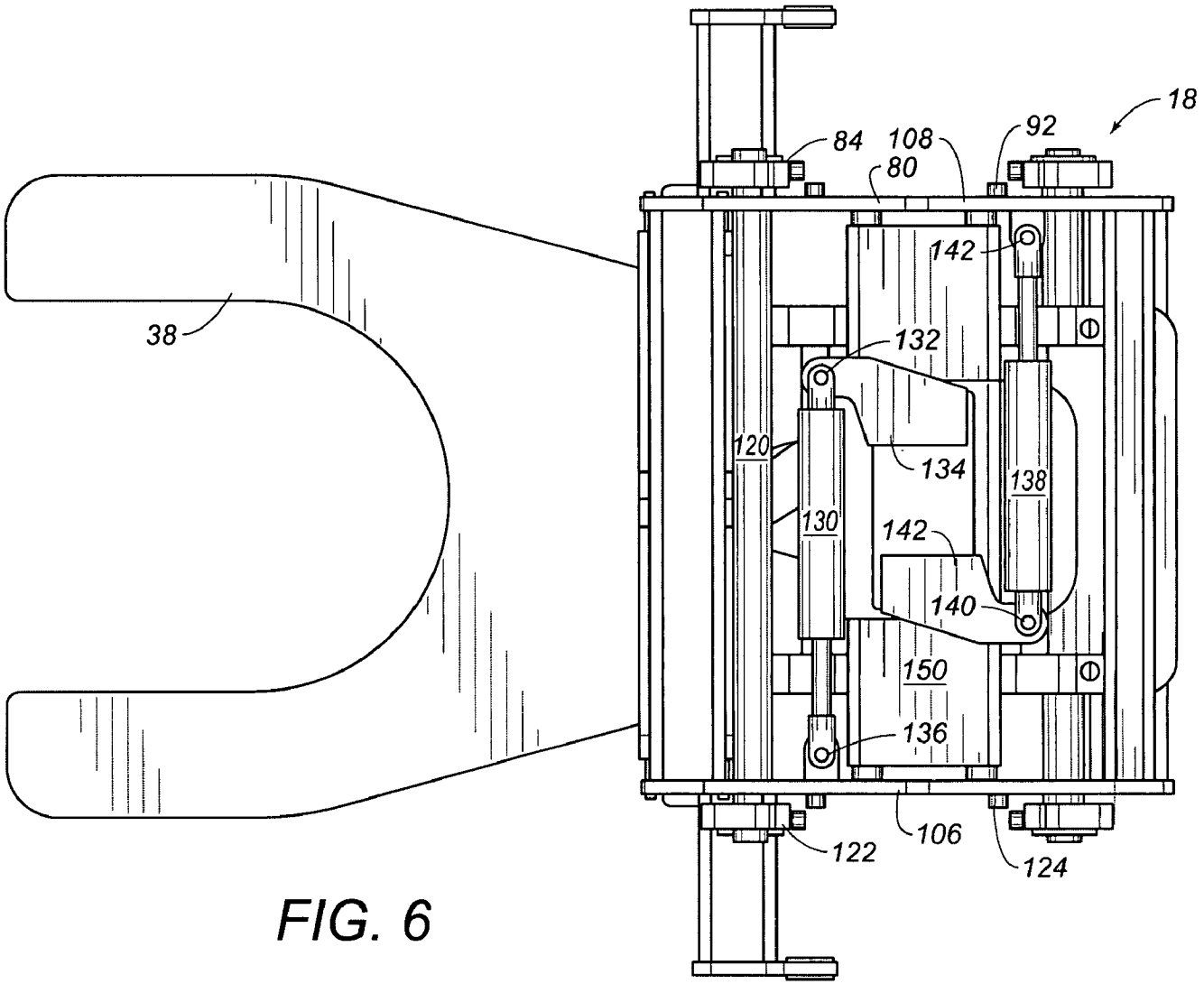
FIG. 6 is a bottom view of the wrench assembly of the present invention with the housing removed therefrom.

FIG. 6 illustrates the underside of positioning mechanism 18. In particular, the underside of the lift plate 38 is particularly illustrated. The housing 80 is illustrated as having its sides 106 and 108 extending in generally parallel relationship to each other. Another pivot shaft 120 will extend between the sides 106 and 108 so as to rotatably support the reaction blocks 84 and 122 at opposite ends thereof. Wear pad 92 faces the reaction block 84. Wear pad 124 will face the reaction block 122.

Importantly, in FIG. 6, the mechanism for the side-to-side movement of the lift plate is particularly illustrated. It can be seen that there is a first cylinder 130 that has one end 132 affixed by a strut 134 to a surface of the lift plate 38. An opposite end of the cylinder 130 is pivotally connected to a gusset 136 secured to the inner surface of side 106 of housing 80. Another double-acting cylinder 138 extends in generally parallel relationship to cylinder 130. Cylinder 138 has an end 140 connected to a strut 142 which is also affixed to the end of the lift plate 38. An opposite end 142 of the cylinder 138 is secured to the side 108 of housing 80. When the double-acting cylinders 130 and 138 are suitably actuated, they will cause the lift plate 38 to be moved in a side-to-side manner between the sides 106 and 108 of housing 80. The arrangement of double-acting cylinders 130 and 138 is intended to provide an offset to the loads prevented by the use of a single cylinder. Additionally, the lift plate 38 can be moved in either direction if there is a failure of either of the cylinders 130 and 138.

Figure 7:
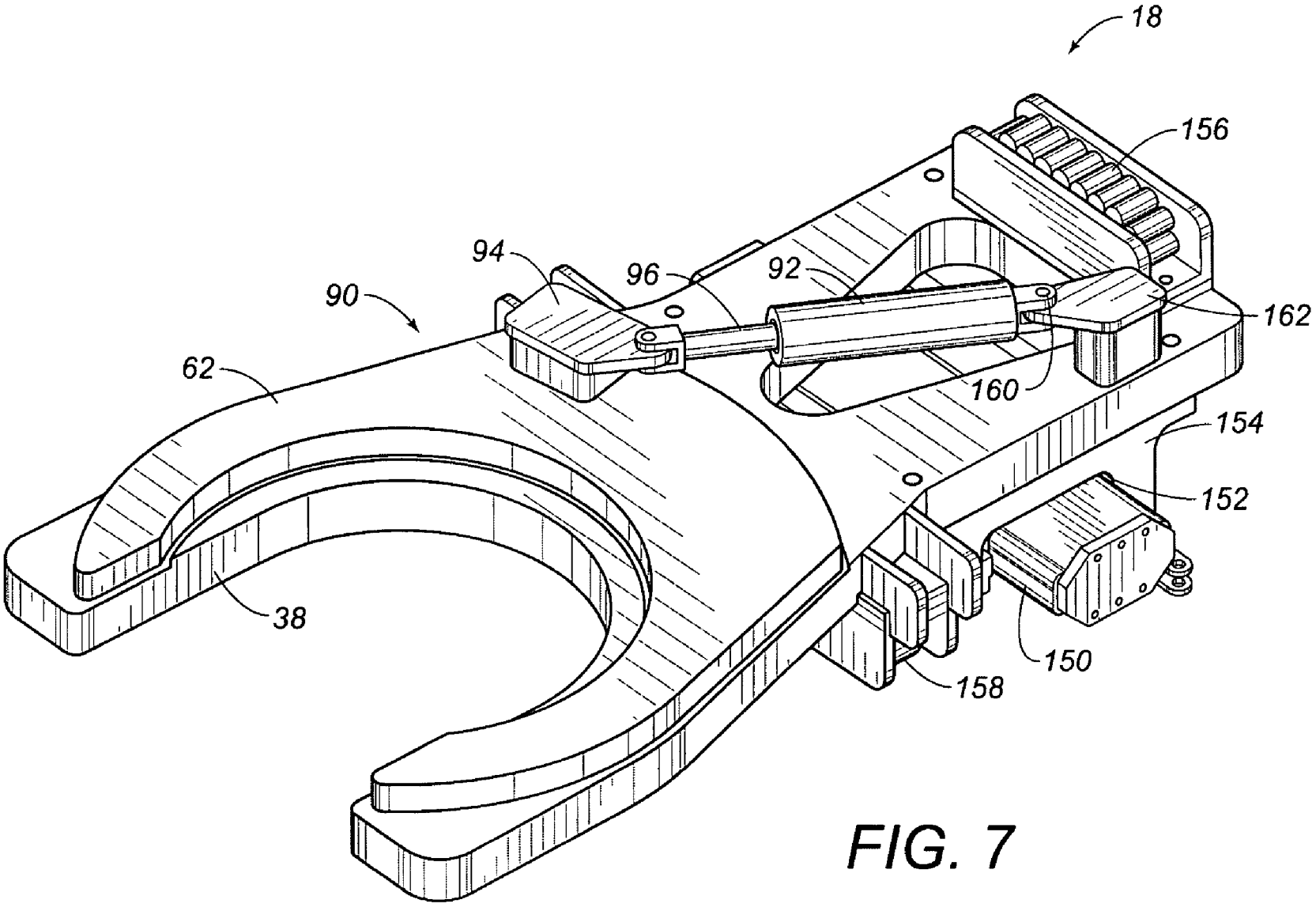
FIG. 7 is a perspective view of the rotary plate and the lift plate mechanism of the wrench assembly of the present invention.

FIG. 7 illustrates the positioning mechanism 18 of the present invention with the housing 80 suitably removed from the wrench assembly 90. In FIG. 7, it can be seen that the piston-and-cylinder assembly 92 has its rod 96 extending outwardly therefrom so as to be pivotally coupled to bracket 94. The rotary plate 62 is illustrated as positioned upon the top surface of the lift plate 38. Importantly, in FIG. 7, a guide member 150 is positioned within a slot 152 formed in the support structure 154 of the wrench assembly 90. When there is side-to-side motion of the lift plate 38 (in the manner described herein previously), the support structure 154 will ride along the exterior surface of the guide member 150. In order to facilitate the movement of the lift plate 30, a first load roller assembly 156 is mounted to the top of the lift plate 38. A similar second load roller assembly 158 will be mounted forward of the first load roller assembly 156 on an underside of the lift plate 38. When the load roller assemblies 156 and 158 are received within the housing 80, these load roller assemblies 156 and 158 will bear against suitable bearing surfaces formed wherein the housing 80. Each of the load roller assemblies 156 and 158 are identified as HILMAN (TM) rollers. In FIG. 7, it can be seen that the piston-and-cylinder assembly 92 is pivotally mounted at an opposite end 160 to a bracket 162 mounted on the top surface of the lift plate 38. As such, the rotational movement of the rotary plate 62 with respect to the lift plate 38 is possible.

Figure 8:
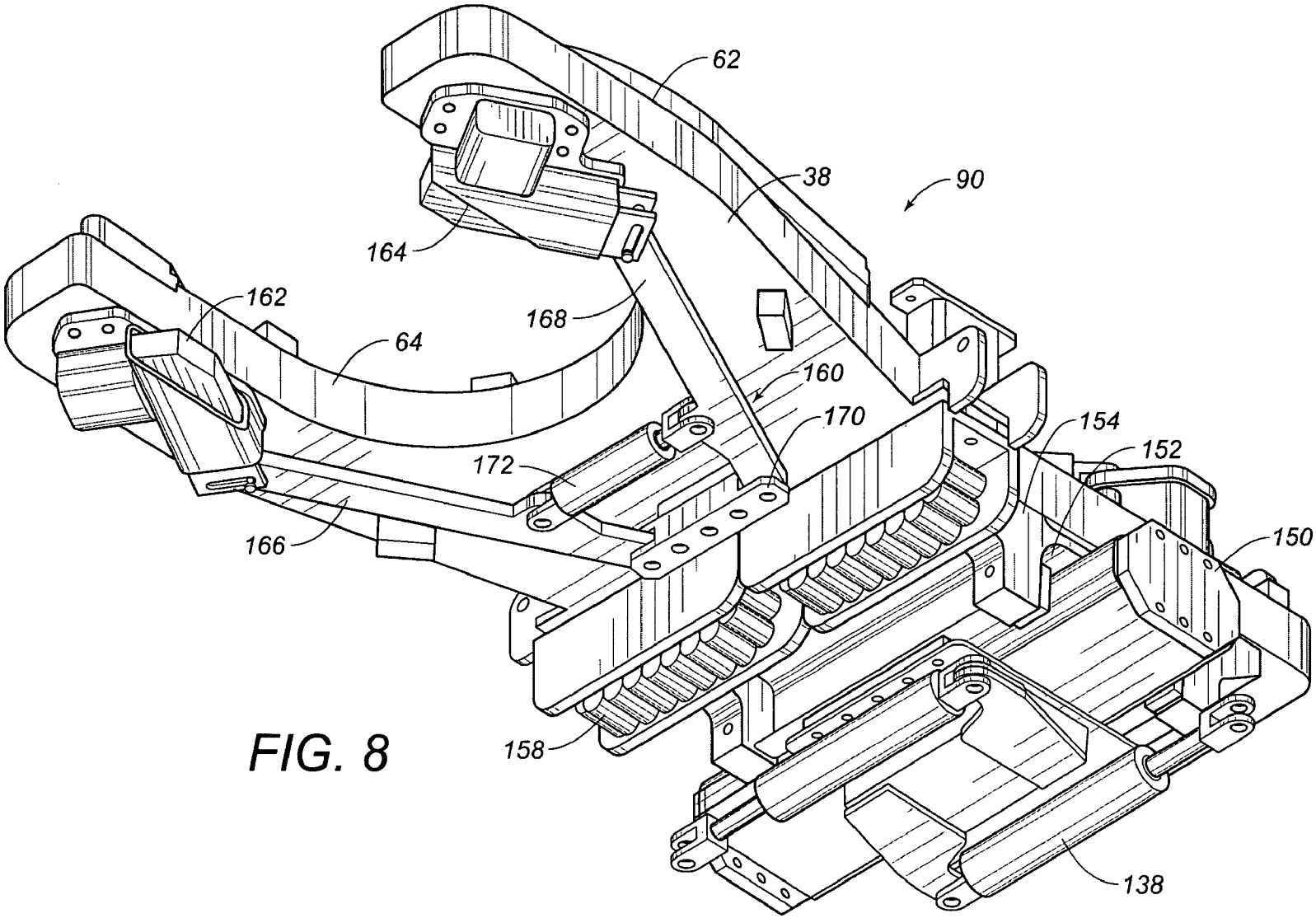
FIG. 8 is a bottom perspective view of the lift plate of the wrench assembly of the present invention.

FIG. 8 shows the underside of the wrench assembly 90 with the housing 80 removed therefrom. In particular, in FIG. 8, the second load roller assembly 158 is particularly illustrated as being located on the underside of the lift plate 38. The guide member 150 is shown as received within the channel 152 formed in the support structure 154 of the lift plate 38. The cylinders 130 and 138 are particularly illustrated as extending in parallel relationship on opposite sides of the guide member 150. The positioning of the first load roller assembly 156 rearwardly of the second load roller assembly 158 will properly distribute loads onto the respective bearing surfaces of the housing 80 when a blowout preventer is placed upon the top of the rotary plate 62.

Importantly, FIG. 8 shows latch mechanism 160 for securing the blowout preventer within the receptacle 64. The latch mechanism 160 has a first restraining clock 162 and a second restraining block 164. Each of the restraining blocks 162 and 164 are pivotally mounted to the underside of the lift plate 38 on opposite sides of the receptacle 64. Control arms 166 and 168 extend to and one pivotally connected to a hinge plate 170. A piston-and-cylinder assembly 172 has opposite ends connected respectively to the control arms 166 and 168. When the piston-and-cylinder assembly 172 is activated outwardly, the arms 166 and 168 will actuate blocks 160 and 162, respectively, so as to pivot inwardly and to retain the blowout preventer within receptacle 64. When the piston-and-cylinder assembly is actuated inwardly, the arms 166 and 168 will pivot outwardly so as to allow the blowout preventer to be received into or released from receptacle 64.

The present invention greatly facilitates the installation of blowout preventers upon the wellhead. FIGS. 9-13 illustrate the operation of the present invention in the installation of such blowout preventers. In particular, in FIG. 9, it can be seen that the blowout preventer 200 has been delivered to the drill site. At the drill site, a cellar 202 has been formed in the earth 204 so as to allow the wellhead conductor 206, along with the wellhead connector 208, to extend therefrom. The cellar 202 is a hole in the ground which allows human access to the areas adjacent to the wellhead connector 208. The drilling substructure 210 is positioned around the wellhead connector 208 so as to provide support to the drilling structure. The wellhead connector 208 is a flange affixed to the top of wellhead connector 206.

Figure 9:
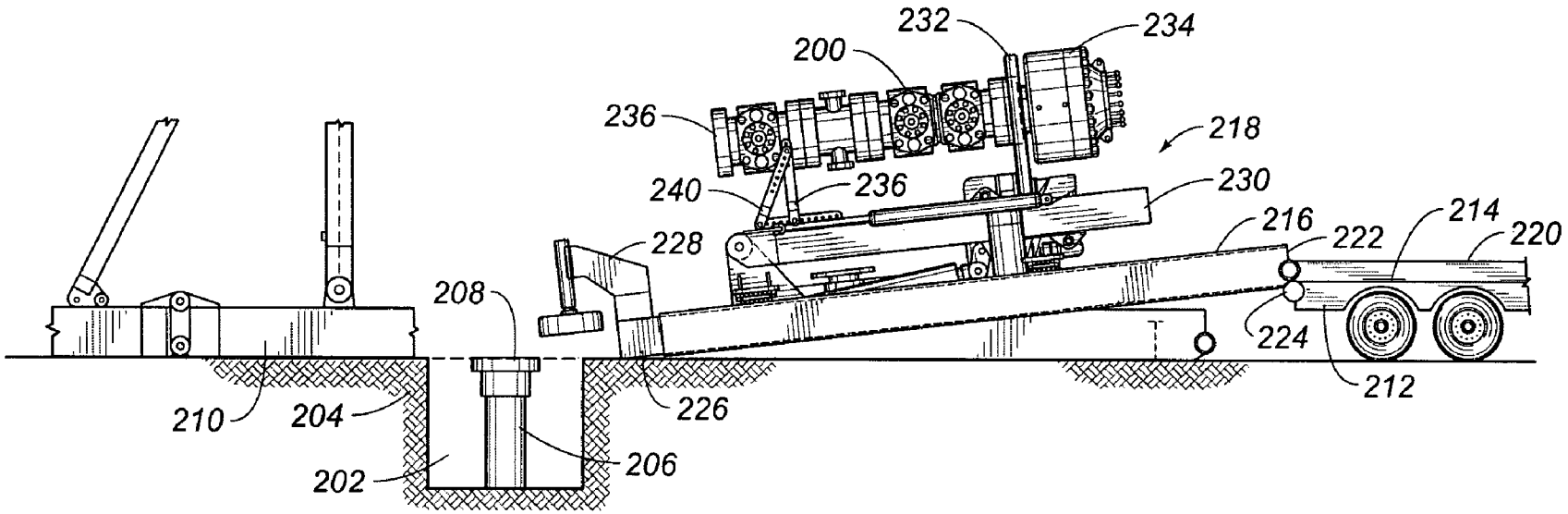
FIG. 9 is a side elevational view showing the initial steps of the method of the present invention.

In FIG. 9, it can be seen that a vehicle 212 has a bed 214 thereon which is used to support the frame structure 216 of the blowout preventer handling apparatus 218 of the present invention. A line 220 is joined to an end 222 of the frame structure 216 so as to allow the frame structure 216 to be dispensed in an area adjacent to the wellhead connector 208. In particular, the frame structure 216 is pushed over a roller 224 at the end of the bed 214 such that the end 226 of the frame structure 216 is positioned in an area adjacent to the cellar 202. The outriggers 228 are illustrated in their retracted positions. It has been found that the vehicle 212 can be moved with sufficient precision so as to deliver the frame structure 216 of the blowout preventer handling apparatus 218 in near proximity to the wellhead connector 208.

The frame structure 216 will slowly be removed from the bed 214 of the vehicle 212 by moving the vehicle 212 away from the cellar 202. Eventually, the frame structure 216 will reside upon the surface of the earth 204. The line 220 can then be released from the end 222 of the frame structure 216 so as to allow the frame structure 216 to reside in its desired position.

In FIG. 9, it can be seen that the raising frame 230 is in its position in generally parallel relationship adjacent to the top surface of the frame structure 216. The positioning mechanism 232 receives a tubular portion of the blowout preventer 200 therein generally adjacent to the underside of the annular 234 of blowout preventer 200. Blowout preventer 200 has its bottom connector 236 positioned at an end of the frame structure 216 adjacent to the wellhead connector 208. Pivot points 238 and 240 serve to secure the blowout preventer 200 in generally parallel relationship to the raising frame 230 and during transport. the bottom connector 236 of the blowout preventer 200 is a flange affixed to the bottom end of the blowout preventer.

Figure 10:
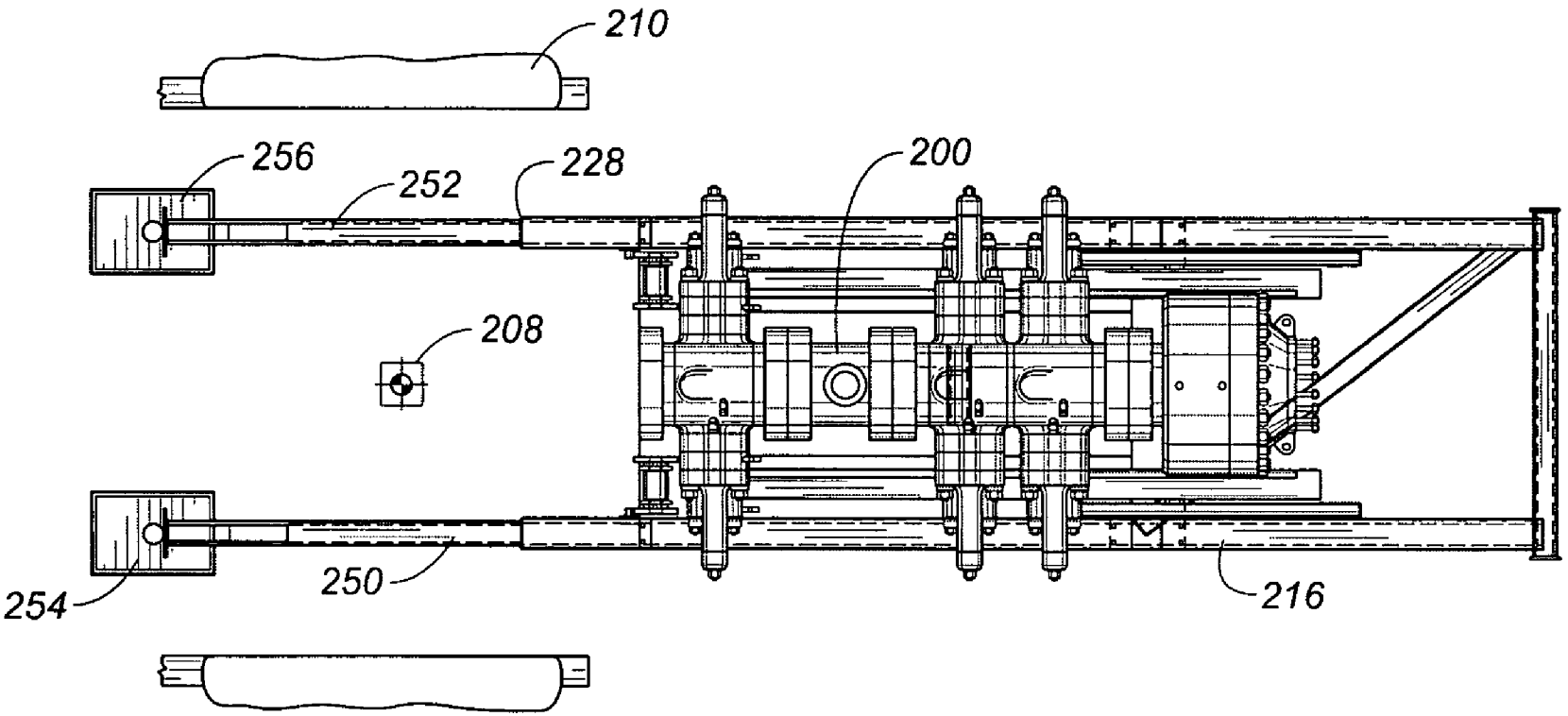
FIG. 10 is a plan view showing the positioning of the blowout preventer handling system of the present invention with respect to the wellhead.

FIG. 10 illustrates the outrigger assembly 228 as extended outwardly prior to the lifting of the blowout preventer 200. The outrigger assembly 228 includes a first beam 250 and a second beam 252. Feet 254 and 256 extend downwardly from the ends of beams 250 and 252, respectively, on a side of the wellhead flange 208 opposite the frame structure 216. The outrigger assembly 228 is located within the drilling rig substructure 210. The outrigger 228 will support the loads and prevent tipping of the loads when the blowout preventer 200 is lifted into its desired position.

Figure 11:
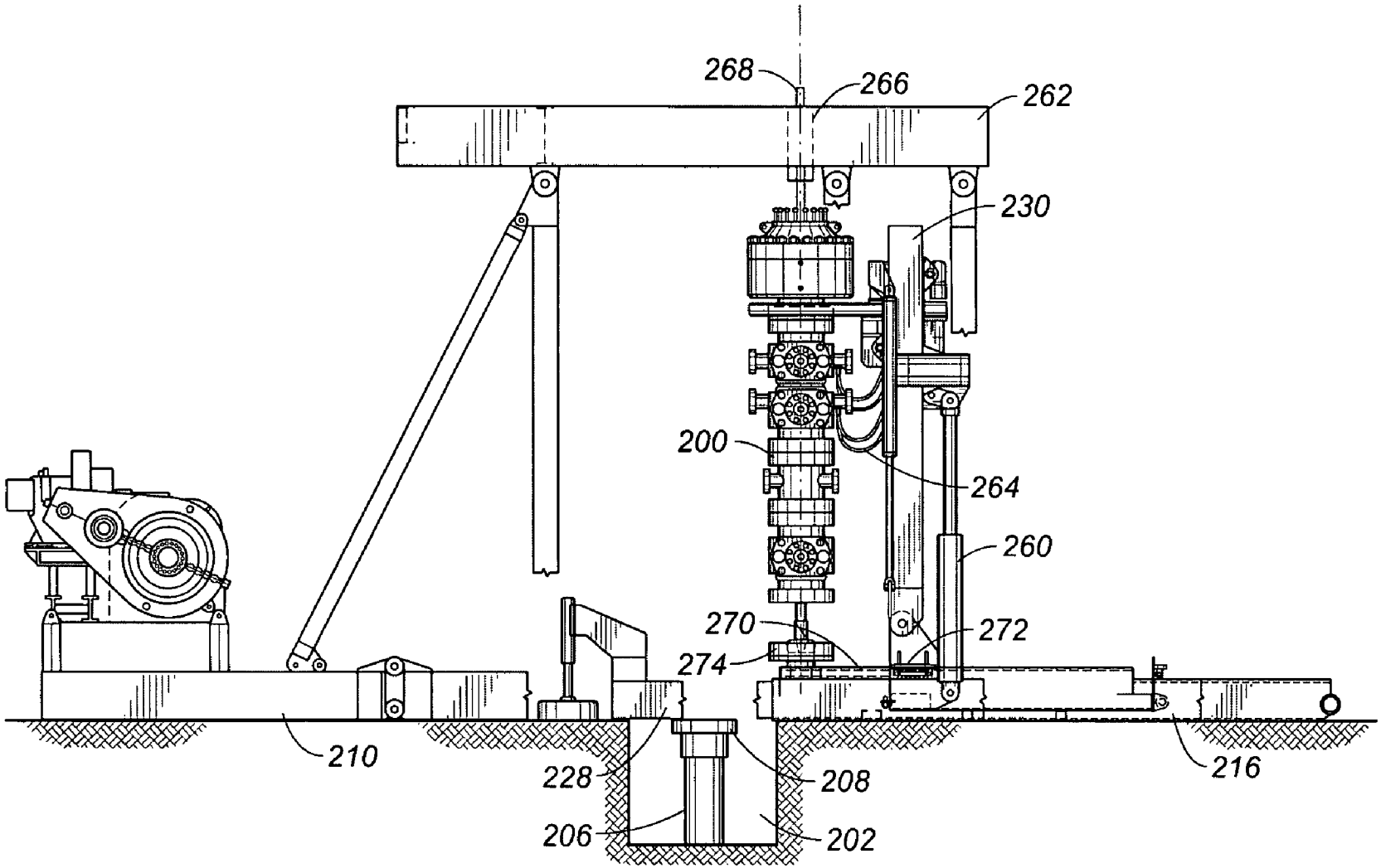
FIG. 11 is a side elevational view showing the elevating of the blowout preventer from the frame structure of the present invention.

FIG. 11 shows the blowout preventer 200 in its vertical lifted position. The raising frame 230 has been lifted by lifting cylinder 260 from its position shown in FIG. 9 to its vertical position. The blowout preventer 200 will extend between the drilling substructure 210 and the drill floor 262.

The outrigger assembly 228 is illustrated as extending across the cellar 202 so as to stabilize the frame structure 216. The accumulator/control hoses 264 can be attached, as required, to the blowout preventer in this position. The blowout preventer 200 is positioned under the drill floor 262 adjacent to the mouse hole opening 266. In this position, a drill pipe test joint 268 can be lowered through the blowout preventer 200 for the purposes of making up the test flange. The tray 270 has been extended outwardly from the carriage 272 to a position below the blowout preventer 200. This test flange 274 can then be connected to the blowout preventer through the drill pipe test joint 268. In this position, the blowout preventer 200 can go through appropriate test procedures prior to installation upon the wellhead connector 208 of wellhead conductor 206.

Figure 12:
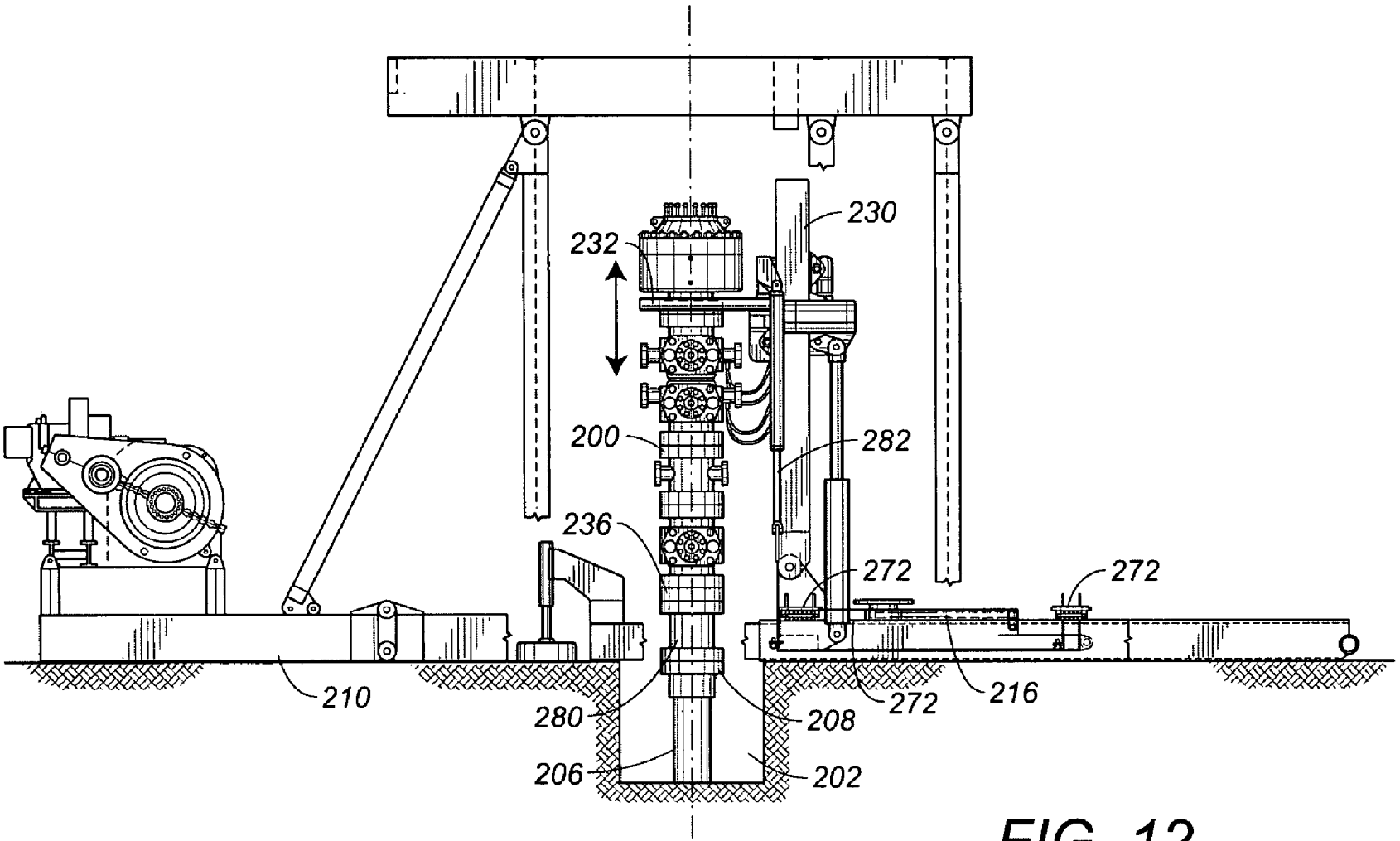
FIG. 12 is a side elevational view showing the placement of the blowout preventer using the handling system of the present invention.

In FIG. 12, the carriage 272 has been suitably extended toward the cellar 202 so that the blowout preventer 200 is positioned directly above the wellhead connector 208. A spacer spool 280 is suitably interposed between the bottom connector 236 of the blowout preventer 200 and the wellhead connector 208. The delivery of the spacer spool 280 will be described hereinafter. The positioning mechanism 232 serves to properly align the bottom connector 236 with the spacer spool 280 and with the connector 208 of the wellhead conductor 206. The positioning mechanism 232 can be suitably lowered on the raising frame 230 by the lift cylinders 282 (in the manner described herein previously). Suitable bolts can be placed through the respective bolt holes of the various flanges so as to secure the blowout preventer 200 to the spacer spool 280 and to the wellhead conductor 206. These actions can be achieved without the need to have personnel in the cellar 202. If alignment of the bolt holes is not properly achieved, then the positioning mechanism 232 can be suitably rotated, by the action of the rotary plate with respect to the lift plate, so that alignment of bolt holes can be achieved. The wellhead connections can then be suitably tested.

Figure 13:
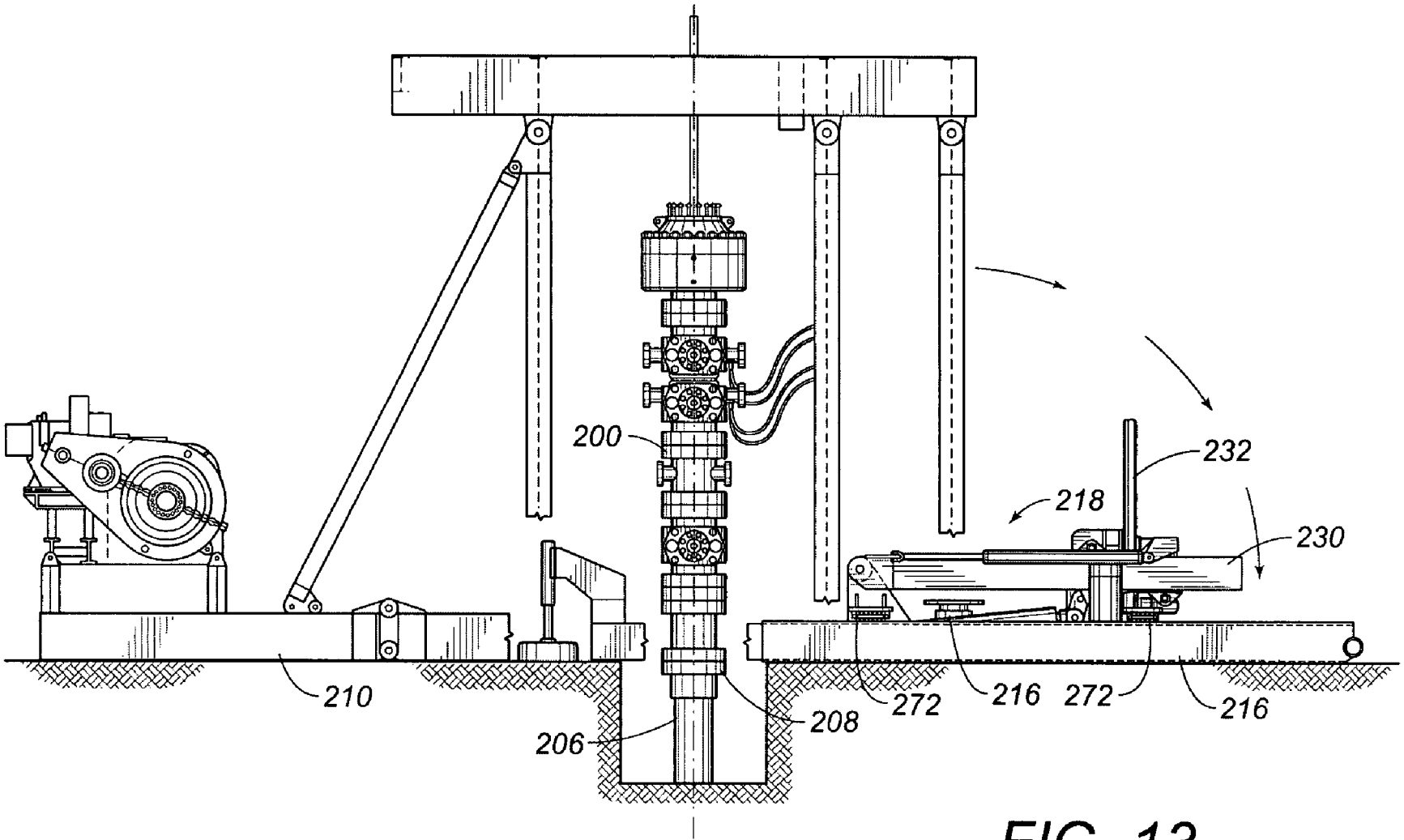
FIG. 13 is a side elevational view showing the final step subsequent to the installation of the blowout preventer.

The concluding procedures associated with the installation of the blowout preventer 200 upon the wellhead conductor 206 and its associated connector 208 are illustrated in FIG. 13. Once the appropriate connections are made, the lift plates of the positioning mechanism 232 can be released from the blowout preventer 200. The carriage 270 can be moved backwardly along the frame structure 216 away from the blowout preventer 200. The raising cylinder can be actuated so as to pivot the raising frame 230 back to its lowered position in generally parallel relationship to the frame structure 216. The tray 270 can also be retracted backwardly away from the blowout preventer 200. After the blowout preventer installation has been completed, in the manner of FIG. 13, the frame structure 216 can reside in a desired position adjacent to the drilling substructure 210 or it can be removed for use in other facilities. For example, vehicle 212 can arrive, receive the frame structure 216 of the blowout preventer handling apparatus 218, and then move the apparatus 218 to another location.

Figure 14:
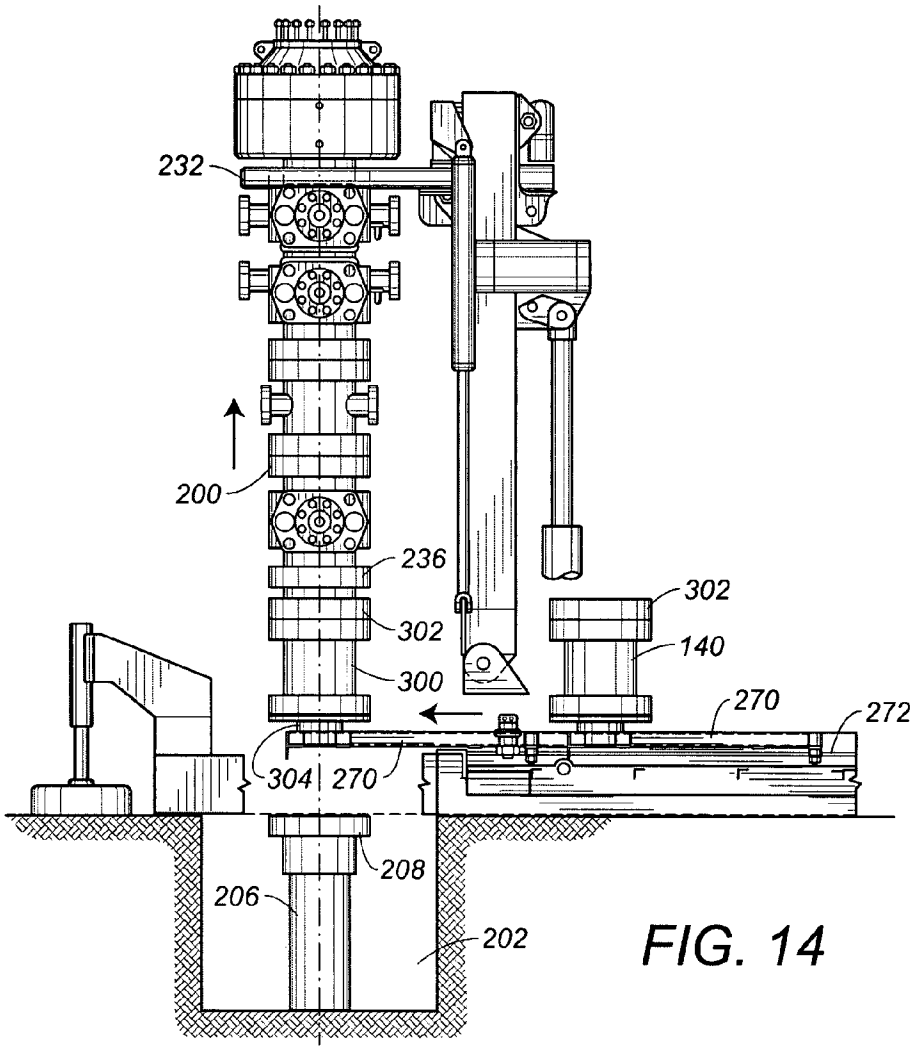
FIG. 14 is a side elevational view showing the operation of the tray for the installation of equipment between the wellhead and the blowout preventer.

FIG. 14 shows the unique manner that the present invention utilizes for the securing of equipment to the bottom connector 236 of a blowout preventer 200. In FIG. 14, it can be seen that the blowout preventer 200 is positioned directly above the wellhead connector 208 of wellhead conductor 206 within cellar 202. The positioning mechanism 232 retains the blowout preventer 200 in its desired position above the wellhead connector 208. A piece of equipment 300 is illustrated in FIG. 14 as supported upon tray 270 of the carriage 272. The piece of equipment 300 is a spacer spool having an adapter flange 302 attached to a top end thereof.

In FIG. 14, the spacer spool 300 and the adapter connector 302 have been pushed outwardly on the tray 270 so as to be positioned directly below the bottom flange 236 of the blowout preventer 200. Since the piece of equipment 300 is placed upon a turntable 304 on tray 270, the spacer spool 300 can be suitably rotated so that the holes associated with either the upper flange of the spacer spool 300 or the holes of the adapter flange 302 are properly aligned with the holes of the bottom connector 236 of blowout preventer 200. The positioning mechanism 232 can make other minor adjustments either rotationally or side-to-side so as to assure this alignment of holes.

Figure 15:
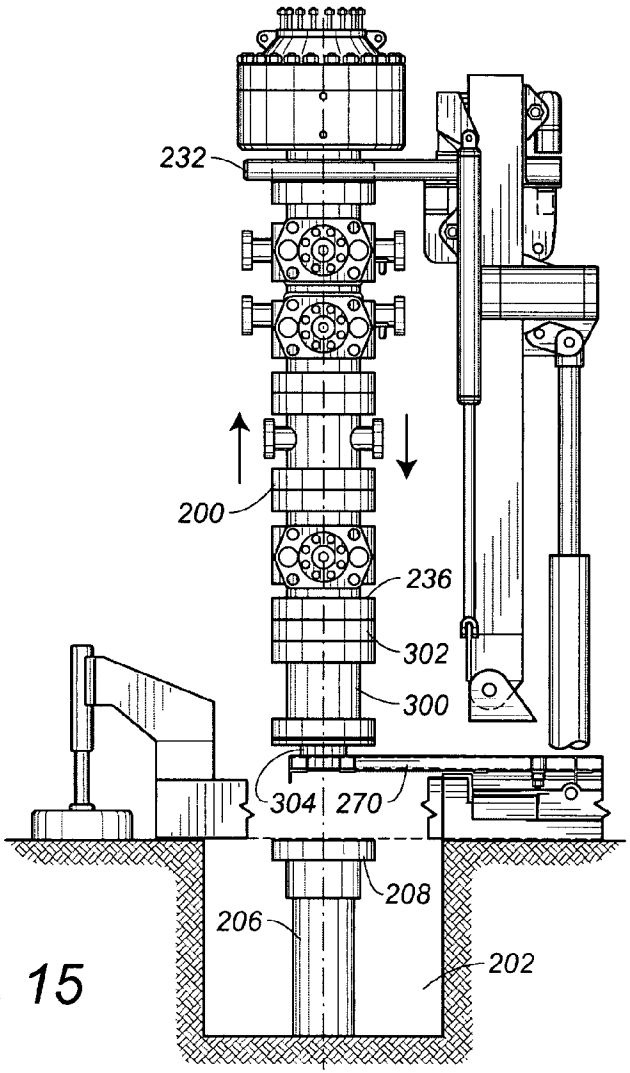
FIG. 15 shows the intermediate step for the placement of a piece of equipment onto the bottom flange of the blowout preventer in accordance with method of the present invention.

In FIG. 15, it can be seen that the spacer spool 300 and its adapter flange 302 have been joined to the bottom connector 236 of blowout preventer 200. This is carried out while the spacer spool 300 is resting upon the tray 270. The tray 270 will extend outwardly over the cellar 202 and in proximity above the top connector 208 of wellhead conductor 206. In this position, the bolt holes associated with the respective flanges 236, 300 and 302 can be suitably aligned so that bolts can be inserted therethrough. Once the bolts are installed, then the spacer spool 300 will be joined to the bottom connector 236 as desired. This can be carried out without any personnel residing in the cellar 202.

Figure 16:
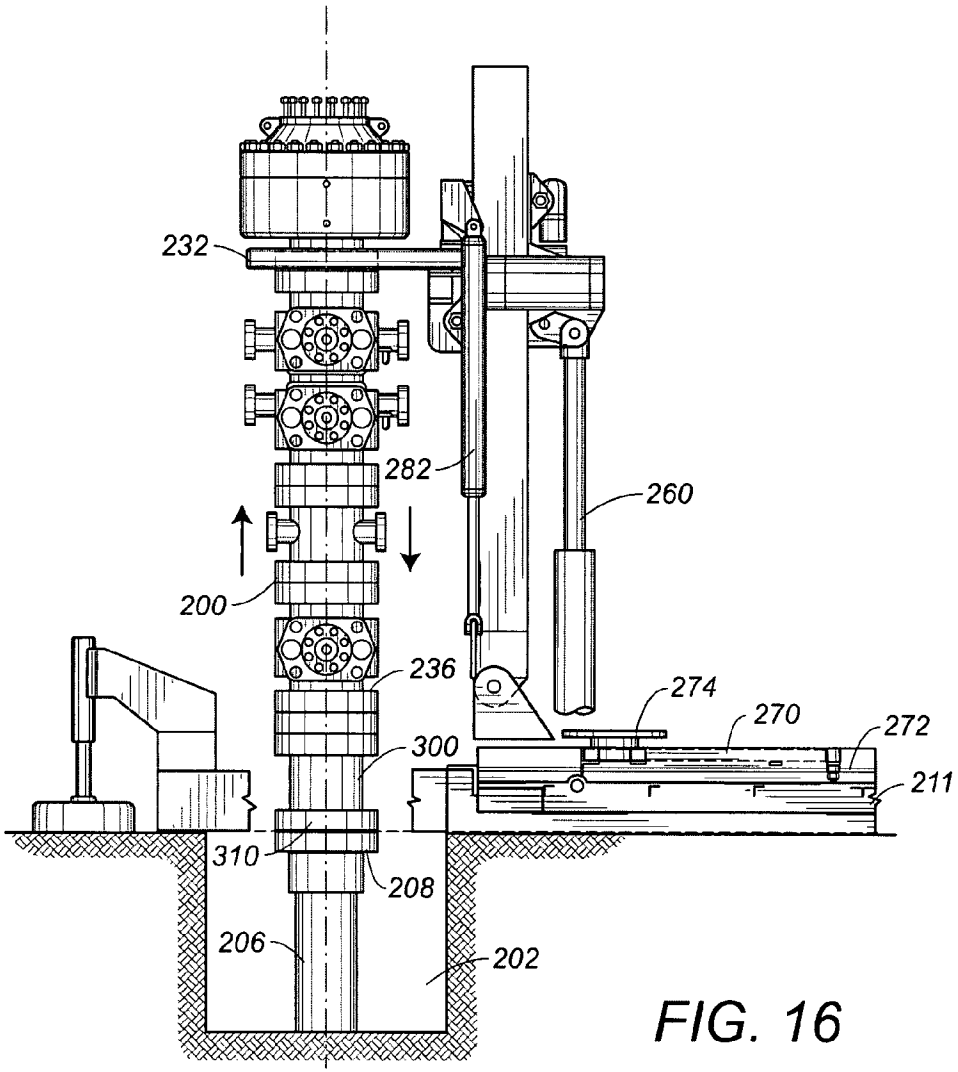
FIG. 16 is a side elevational view showing the completion of the installation of a spacer spool between the blowout preventer and the flange of the wellhead using the method of the present invention.

FIG. 16 illustrates the final step of process. The tray 270 with its turntable 274 are retracted along the carriage 272 on the frame structure 216. The positioning mechanism 232 can then, in conjunction with lifting cylinder 282, lower the blowout preventer 200 so that the facing surfaces of the bottom flange of the spacer spool 300 will be juxtaposed against the top connector 208 of wellhead conductor 206. Ideally, the bolt holes of the bottom flange 310 of the spacer spool 300 will be aligned with the holes on the top connector 208 of wellhead conductor 206. However, if such alignment is not possible, then the positioning mechanism 232 can be suitably rotated so that the holes align with each other. Other adjustments for misalignment of bolt holes can be achieved by the side-to-side motion of the positioning mechanism 232, by the forward-and-backward movement of the carriage 272 with respect to the frame structure 216, or by angular and pivotal movements caused by the raising cylinder 260.

Subsequent to installation, the positioning mechanism 232 can be released from the blowout preventer 200 so that the blowout preventer 200, along with its spacer spool 300 are suitably connected to the wellhead conductor 206.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

We claim:

1. A blowout preventer handling apparatus comprising:

a frame structure;

a carriage slidably supported on said frame structure;

a raising frame pivotally supported on said carriage, said raising frame pivotable between a first position in generally parallel adjacent relation to said carriage and a second position generally transverse to said carriage; and a positioning means cooperatively connected to said raising frame or to said carriage, said positioning means for receiving the blowout preventer therein and for moving the blowout preventer upwardly-and-downwardly and rotationally and side-to-side, said carriage comprising:

a carriage frame mounted by a roller assembly on a surface of said frame structure; and a driving means having one end connected to said carriage frame and an opposite end connected to said frame structure, said driving means for selectively moving said carriage frame along said surface of said frame structure; and a tray slidably supported on said carriage between sides of said frame structure, said tray movable between a first position away from said positioning means to a position directly below said positioning means.

2. The apparatus of claim 1, said tray having a turntable thereon, said turntable being rotatably mounted to said tray.

3. The apparatus of claim 1, said raising frame comprising:

at least one post pivotally connected to said carriage; and a raising means having one end connected to said carriage and an opposite end connected the post, said raising means for moving the post from said first position to said second position.

4. The apparatus of claim 3, said positioning means slidably connected to the post, said positioning means comprising:

a lift means having an end connected to the post, said lift means for moving the blowout preventer upwardly and downwardly.

5. The apparatus of claim 3, said positioning means comprising:

a wrench frame slidably positioned on said raising frame, said wrench frame having a blowout preventer receptacle therein;

a rotary means connected to said wrench frame, said rotary means for rotating the blowout preventer receptacle; and a transverse means connected to said wrench frame for moving said blowout preventer receptacle side-to-side with respect to said wrench frame.

6. The apparatus of claim 5, said positioning means further comprising:

a lift means having one end connected to said raising frame and an opposite end connected to said wrench frame, said lift means for moving said wrench frame upwardly and downwardly.

7. The apparatus of claim 5, said wrench frame comprising:

a housing;

a lift plate having said blowout preventer receptacle formed therein and extending outwardly of said housing;

a rotary plate mounted on said lift plate and having a surface thereon for receiving the blowout preventer; and a guide member affixed to said housing and extending thereacross.

8. The apparatus of claim 7, said rotary means comprising:

a piston-and-cylinder assembly having one end connected to said rotary plate and an opposite end connected to said lift plate, said piston-and-cylinder assembly actuatable so as to rotate said rotary plate relative to said lift plate.

9. A blowout preventer handling apparatus comprising:

a frame structure;

a carriage slidably supported on said frame structure;

a raising frame pivotally supported on said carriage, said raising frame pivotable between a first position in generally parallel adjacent relation to said carriage and a second position generally transverse to said carriage; and a positioning means cooperatively connected to said raising frame or to said carriage, said positioning means for receiving the blowout preventer therein and for moving the blowout preventer upwardly-and-downwardly and rotationally and side-to-side, said positioning means comprising:

a wrench frame slidably positioned on said raising frame, said wrench frame having a blowout preventer receptacle therein;

a rotary means connected to said wrench frame, said rotary means for rotating the blowout preventer receptacle; and a transverse means connected to said wrench frame for moving said blowout preventer receptacle side-to-side with respect to said wrench frame, said wrench frame comprising:

a housing;

a lift plate having said blowout preventer receptacle formed therein and extending outwardly of said housing;

a rotary plate mounted on said lift plate and having a surface thereon for receiving the blowout preventer; and a guide member affixed to said housing and extending thereacross, said transverse means comprising a piston-and-cylinder assembly having one end connected to said lift plate and an opposite end connected to said housing, said lift plate being slidably supported on said guide member, said piston-and-cylinder assembly being selectively actuatable so as to move said lift plate along said guide member.

10. A wrench assembly for a blowout preventer handling system comprising:

a housing;

a lift plate having a blowout preventer receptacle formed therein and extending outwardly of said housing;

a rotary plate mounted on said lift plate and having a surface thereon for receiving the blowout preventer;

a rotating means having one end connected to said rotary plate and an opposite end connected to said lift plate, said rotating means being selectively actuatable for rotating said rotary plate relative to said lift plate;

a guide member affixed to said housing and extending thereacross, said lift plate being slidably mounted on said guide member; and a translating means having one end connected to lift plate and an opposite end connected to said housing, said translating means being selectively actuatable for moving said lift plate along said guide member.

11. The wrench assembly of claim 10, further comprising:

a latching means affixed to said lift plate, said latch means for releasably retaining the blowout preventer in said receptacle.

12. A wrench assembly for a blowout preventer handling system comprising:

a housing;

a lift plate having a blowout preventer receptacle formed therein and extending outwardly of said housing;

a rotary plate mounted on said lift plate and having a surface thereon for receiving the blowout preventer;

a rotating means having one end connected to said rotary plate and an opposite end connected to said lift plate, said rotating means being selectively actuatable for rotating said rotary plate relative to said lift plate;

a first load roller assembly mounted to a top surface of said lift plate; and a second load roller assembly mounted to a bottom surface of said lift plate, said first load roller assembly being rollable against a first bearing surface on said housing, said second load roller assembly being rollable against a second bearing surface on said housing.

13. The wrench assembly of claim 12, further comprising:

a raising frame having said housing slidably mounted thereon; and a lifting means having one end connected to said raising frame and an opposite end connected to housing, said lifting means being selectively actuatable for moving said housing along said raising frame.

14. A transport assembly for a blowout preventer handling system comprising:

a frame structure;

a carriage slidably mounted on said frame structure;

a blowout preventer positioning means cooperatively connected to said carriage, said positioning means for receiving the blowout preventer therein and for moving the blowout preventer upwardly and downwardly and rotationally and side-to-side; and a transport structure supported on either the frame structure or the carriage, said transport structure being moveable between a first position away from said positioning means to a position directly below said positioning means, said transport structure being a tray slidably supported on said carriage between said sides of said frame structure, said tray having a turntable thereon, said turntable being rotatably mounted to said tray.

15. The transport assembly of claim 14, said carriage comprising:

a carriage frame mounted by a roller assembly on a surface of said frame structure; and a cylinder means having one end connected to said carriage frame and an opposite end connected to said frame structure, said cylinder means for selectively moving said carriage frame along said surface of said frame structure.

16. The transport assembly of claim 14, said positioning means slidably connected to at least one post pivotally supported upon said carriage, said positioning means comprising:

a lifting means having an end connected to the post, said lifting means for moving the blowout preventer upwardly and downwardly;

a wrench frame slidably positioned on the post, said wrench frame having a blowout preventer receptacle thereon;

a rotary means connected to said wrench frame, said rotary means for rotating said blowout preventer receptacle; and a transverse means connected to said wrench frame for moving said blowout preventer receptacle side-to-side with respect to said wrench frame.

17. A method of handling a blowout preventer comprising:

moving a frame structure into proximity to a wellhead, said frame structure having a raising frame pivotally supported on a carriage slidably mounted thereon, said raising frame having a blowout preventer supported thereon by a wrench assembly;

raising the blowout preventer upwardly by pivoting said raising frame with respect to said carriage;

extending said carriage outwardly such that a bottom connector of the blowout preventer is in proximity to a top connector of the wellhead;

manipulating said wrench assembly such that said bottom connector is aligned with said top connector; and extending an outrigger assembly outwardly of said frame structure, said outrigger assembly having feet at an end opposite said frame structure, said feet being positioned on a side of the wellhead opposite said frame structure.

18. The method of claim 17, said step of manipulating comprising:

rotating the blowout preventer by pivoting said wrench assembly so as to axially align bolt holes of said bottom connector with bolt holes of said top connector.

19. The method of claim 17, said step of manipulating comprising:

moving said wrench assembly side-to-side such that a center of said bottom connector is aligned with a center of said top connector.

20. The method of claim 17, said step of manipulating comprising:

sliding said carriage toward or away from the wellhead such that a center of said bottom connector is aligned with a center of said top connector.

21. The method of claim 17, said wrench assembly extending transversely outwardly of said raising frame, said step of manipulating comprising:

pivoting said raising frame angularly with respect to said carriage such that a bottom surface of said bottom connector is in parallel planar relationship to a top surface of said top connector.

22. The method of claim 17, said step of manipulating comprising:

moving said wrench assembly upwardly or downwardly on said raising frame such that said bottom connector is juxtaposed against said top connector.

23. The method of claim 17, said step of manipulating comprising:

adjusting a height of said frame structure from said feet so as to position a bottom surface of said bottom connector in parallel planar relationship with a top surface of said top connector.

24. The method of claim 17, further comprising:

transporting said frame structure on a bed of a vehicle to the wellhead;

off-loading an end of said frame structure in proximity to the wellhead, said frame structure extending angularly off an end of said bed;

moving said vehicle away from said end of said frame structure; and releasing the frame structure from the bed of the vehicle.

25. A method of handling a blowout preventer comprising:

moving a frame structure into proximity to a wellhead, said frame structure having a raising frame pivotally supported on a carriage slidably mounted thereon, said raising frame having a blowout preventer supported thereon by a wrench assembly;

raising the blowout preventer upwardly by pivoting said raising frame with respect to said carriage;

extending said carriage outwardly such that a bottom connector of the blowout preventer is in proximity to a top connector of the wellhead; and manipulating said wrench assembly such that said bottom connector is aligned with said top connector, said carriage having a tray slidably supported thereon;

positioning a piece of equipment on said tray;

sliding said tray and said piece of equipment outwardly of said end of said carriage so as to be in proximity to the wellhead; and removing the piece of equipment from said tray.

26. The method of claim 25, said piece of equipment being a spacer spool having a top flange and a bottom flange, the method further comprising:

moving said tray such that said top flange of said spacer spool is aligned with said bottom connector of said blowout preventer;

bolting said top flange of said spacer spool to said bottom flange of said blowout preventer;

sliding said tray away from said bottom flange of said spacer spool; and lowering the blowout preventer and the spacer spool toward said top connector of said wellhead such that said bottom flange of said spacer spool is juxtaposed against said top connector of said wellhead.

27. The method of claim 26, further comprising:

manipulating said blowout preventer by said wrench assembly such that bolt holes of said spacer spool are axially aligned with bolt holes of said top connector of said wellhead.

28. The method of claim 27, further comprising:

securing bolts through said respective pairs of bolt holes in said bottom connector of said blowout preventer and said top connector of said wellhead;

releasing said wrench assembly from said blowout preventer;

retracting said carriage along said frame structure; and pivoting said raising frame downwardly so as to be positioned in generally parallel relationship to said frame structure.

* * * * *